US008061989B1

(12) United States Patent
Liang

(10) Patent No.: US 8,061,989 B1
(45) Date of Patent: Nov. 22, 2011

(54) TURBINE BLADE WITH NEAR WALL COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 565 days.

(21) Appl. No.: 12/254,351

(22) Filed: Oct. 20, 2008

(51) Int. Cl.
*F01D 5/08* (2006.01)

(52) U.S. Cl. ..... 416/97 R

(58) Field of Classification Search ..... 415/110; 416/92, 97 R, 97 A
See application file for complete search history.

(56) References Cited

U.S. PATENT DOCUMENTS 5,702,232 A * 12/1997 Moore ..... 416/95
7,674,093 B2 * 3/2010 Lee et al. ..... 416/97 R
7,766,616 B2 * 8/2010 Baldauf et al. ..... 416/97 R

* cited by examiner

*Primary Examiner* — Chandra Chaudhari
(74) *Attorney, Agent, or Firm* — John Ryznic

(57) ABSTRACT

A turbine blade with a pressure side wall having a plurality of radial extending near wall cooling channels to provide near wall cooling, where each radial channel includes a converging channel with an opening that discharges cooling air out from the blade tip in a direction offset toward an on-coming hot gas flow to reduce leakage. A plurality of radial cooling channels extends along the pressure side wall and a concave shaped depression formed in the pressure side wall adjacent to the radial channels provides a deflecting surface for the flow on the pressure side wall surface. If the blade tip forms a squealer pocket, then the suction side tip rail can also include radial extending channels with converging channels formed within the tip rail to discharge cooling air toward the leakage at the suction side tip rail.

15 Claims, 4 Drawing Sheets

Prior Art
View B-B

TURBINE BLADE WITH NEAR WALL COOLING

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a turbine blade with near wall cooling and tip sealing.

2. Description of the Related Art Including Information Disclosed Under 37 CFR 1.97 and 1.98

In a gas turbine engine, turbine airfoils such as rotor blades and stator vanes are cooled by passing pressurized cooling air through internal cooling air passages to produce convection cooling, impingement cooling and even film cooling of the outer airfoil surface in order to allow for higher gas flow temperatures across these airfoils. Higher turbine inlet temperatures allow for higher efficiencies of the turbine and therefore of the engine. However, the highest obtainable turbine inlet temperature is limited to the metal properties of the airfoils. Improved cooling and sealing of these airfoils will allow for higher temperatures and therefore improved performance.

U.S. Pat. No. 5,702,232 issued to Moore on Dec. 30, 1997 and entitled COOLED AIRFOILS FOR A GAS TURBINE ENGINE discloses a turbine blade with pressure and suction side walls formed around a cooling air feed chamber, where the two walls include rows of radial extending cooling air passages that extend along the entire airfoil surface and provide convection cooling to the airfoil walls. FIG. 1 shows this blade cooling system. Re-supply holes connected each radial passage to the feed chamber to re-supply cooling air and produce impingement cooling of the inner wall surface. Film cooling holes also discharge film cooling air from the radial passages and onto the outer airfoil surface. The cooling air from the radial passages also discharges out from the blade tip to produce sealing against the blade outer air seal of the engine shroud.

FIG. 2 shows one disadvantage of the blade cooling radial channels of the prior art discussed above. For the blade mid-chord section cooled with the radial flow channels, the near wall radial flow channel at the tip discharge section experiences external cross flow effect. This is represented by the arrows in FIG. 1. Because of this cross flow effect, an over-temperature will occur at the locations of the blade pressure tip regions. This external cross flow effect on the near wall radial flow channel is caused by the non-uniformity of the radial channel discharge pressure profile and the blade tip leakage flow across the radial channel exit location.

BRIEF SUMMARY OF THE INVENTION

It is an object of the present invention to provide for a turbine blade with an improved near wall cooling over the cited prior art.

It is another object of the present invention to provide for a turbine blade with an improved tip sealing over the cited prior art.

It is another object of the present invention to provide for a turbine blade with decreased external cross flow effect over the cited prior art.

It is another object of the present invention to provide for a turbine blade with decreased blade tip over-temperature than the cited prior art.

It is another object of the present invention to provide for a turbine blade with a more uniform radial discharge pressure profile across the radial channel exit location of the turbine blade with radial flow cooling air passages within the walls.

The turbine blade of the present invention includes a central cooling air supply cavity formed between the pressure side and suction side walls, and radial cooling air passages extending through the side walls along the entire airfoil surface to provide near wall cooling for the airfoil walls. The radial flow passages discharge the cooling air out through the tip to provide sealing with the blade outer air seal. An internal curved surface is formed on the pressure side wall just below the tip corner that extends along the pressure side airfoil wall. The curved surface is slanted toward the blade pressure side tip corner and is built into the radial cooling discharge location. The internal curved surface on the cooling channel exit functions as a cooling air flow deflector while the slanted blade cooling channel exit functions to pinch the leakage flow and eliminate the prior art cross flow effect over the blade tip.

DETAILED DESCRIPTION OF THE INVENTION

Figure 1:
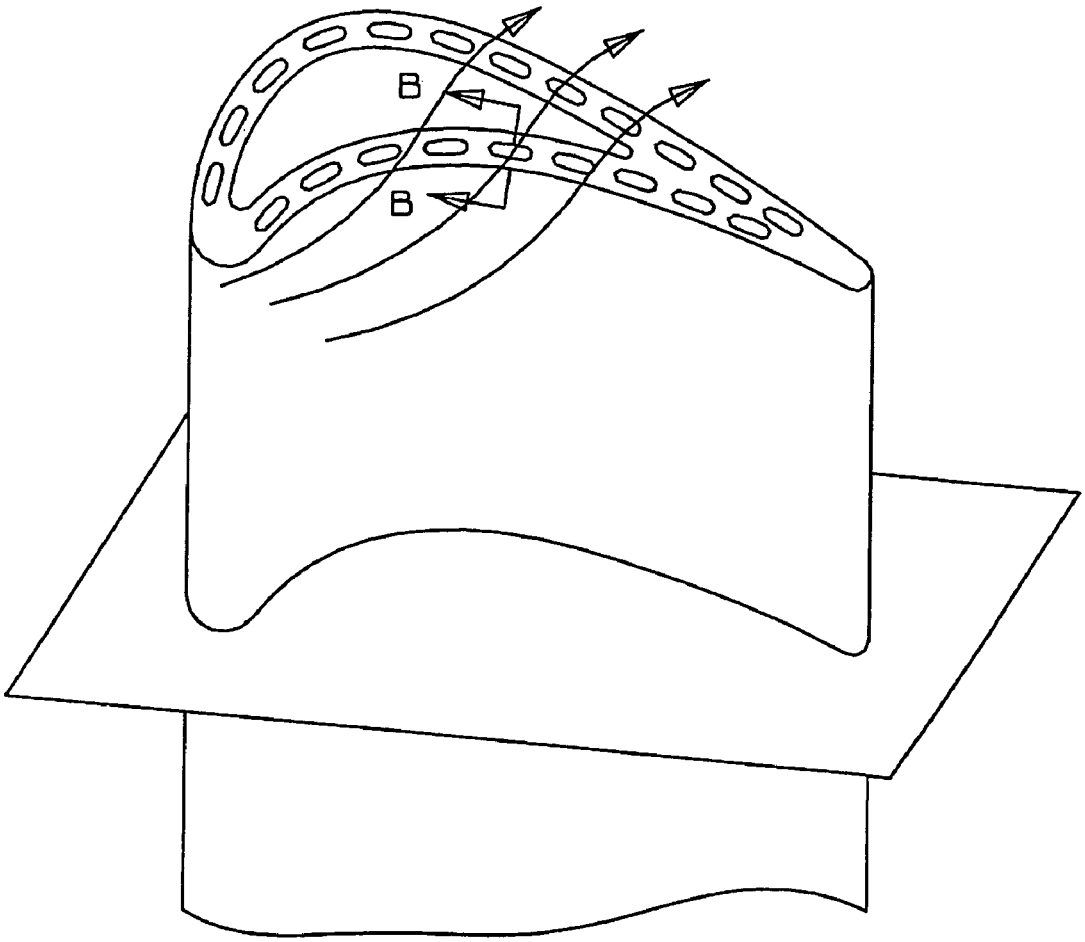
Prior Art Fig 1
FIG. 1 shows a prior art turbine blade with radial cooling passages within the airfoil walls and a central cooling cavity.
Figure 2:
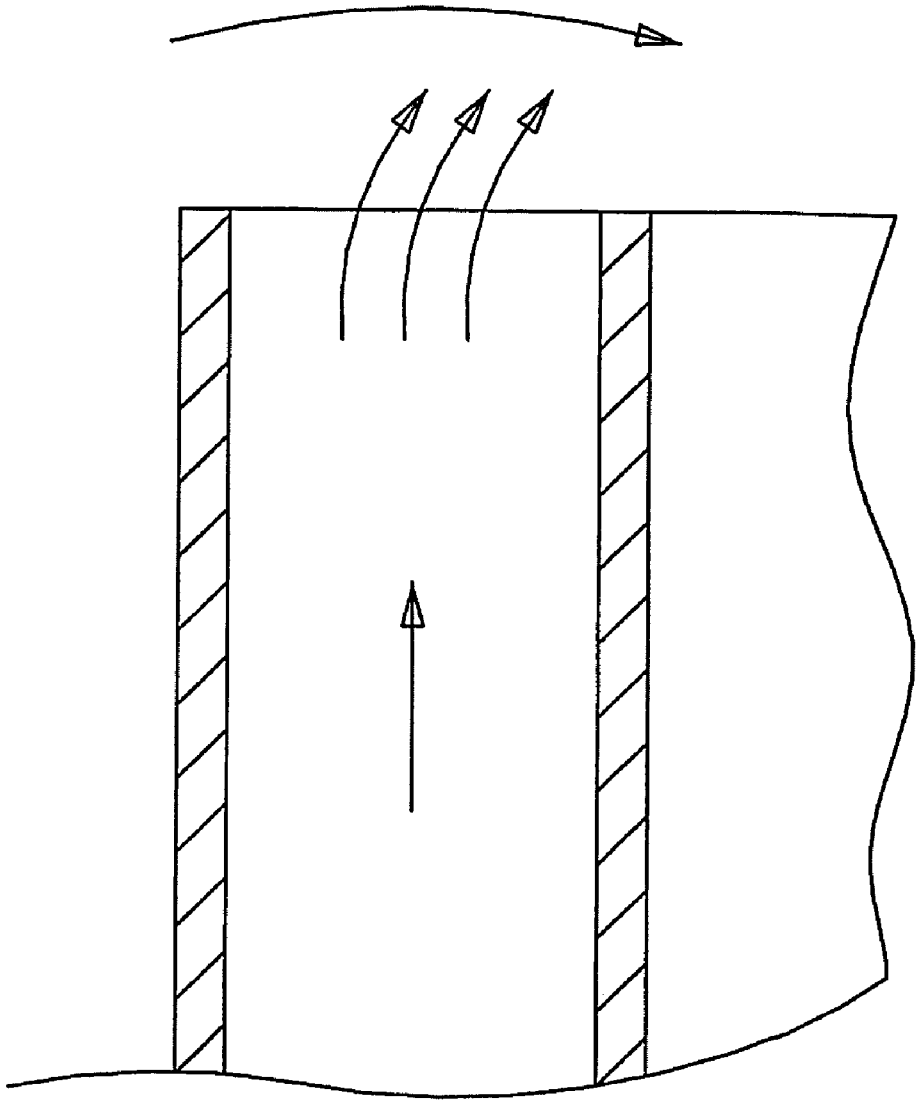
FIG. 2 shows a cross section side view through a section of the pressure side wall and radial flow cooling passage in the prior art blade of FIG. 1.
Figure 3:
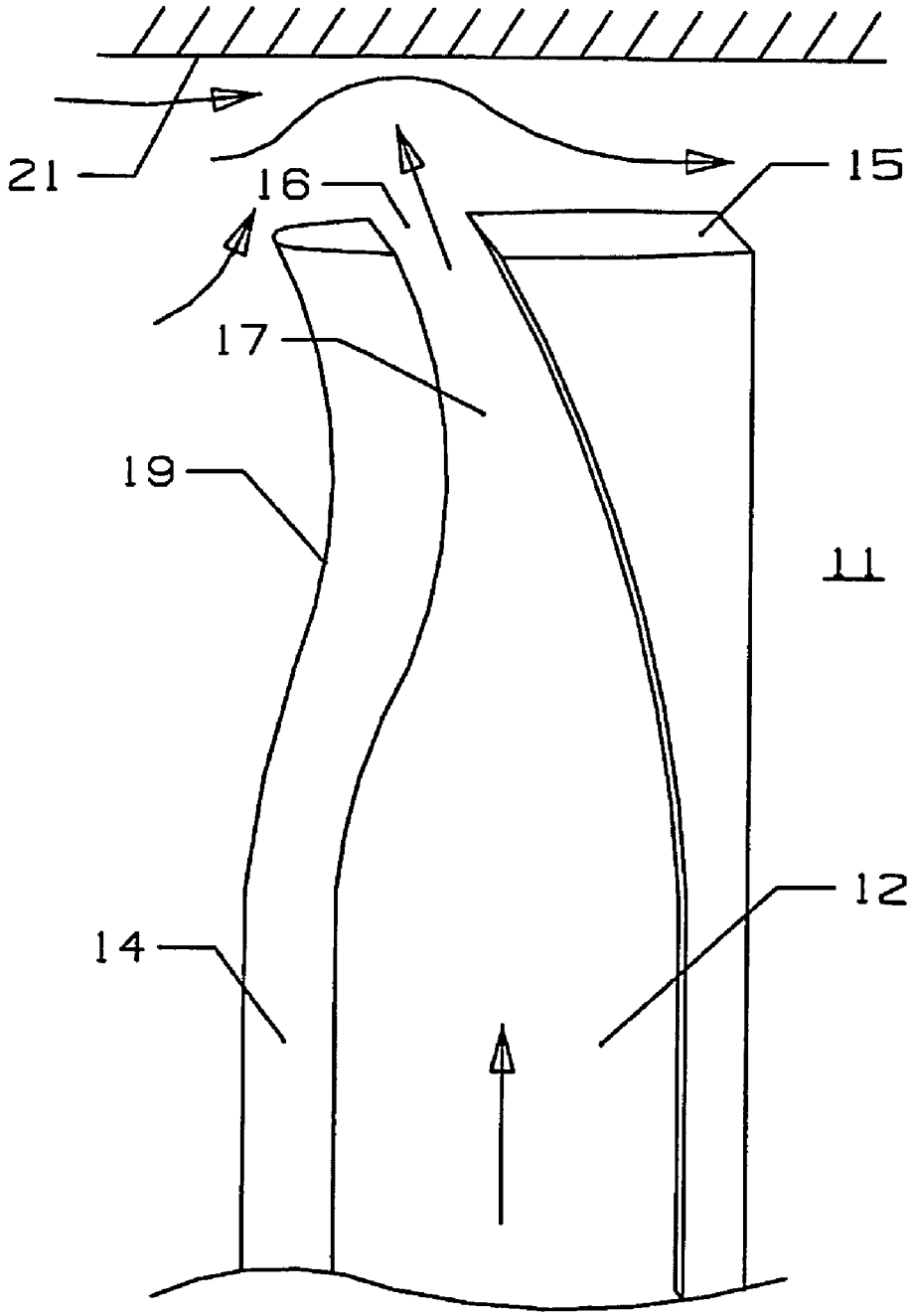
FIG. 3 shows a cross section side view of a radial cooling passage of the turbine blade of the present invention.
Figure 4:
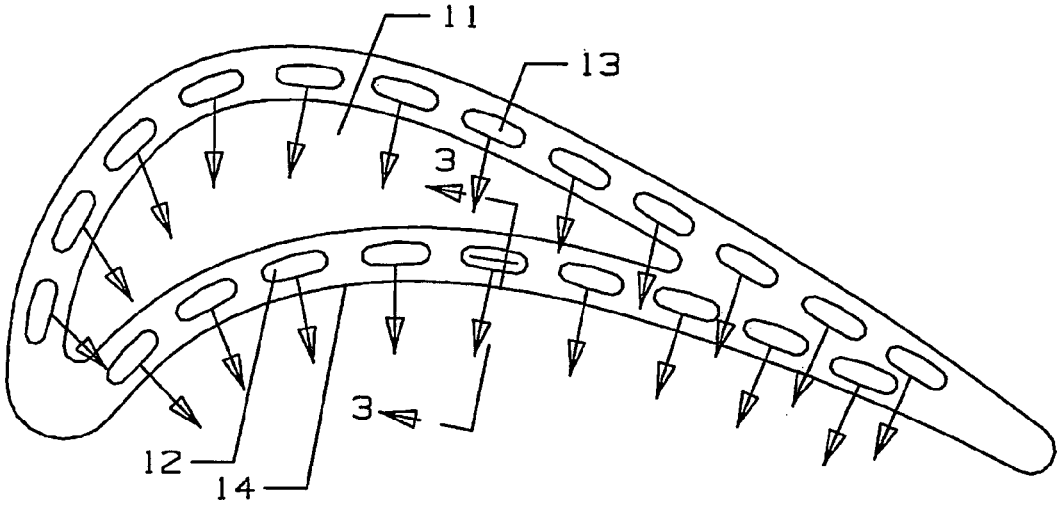
FIG. 4 shows a cross section top view of the turbine blade of the present invention.

The turbine blade with the near wall cooling channels of the present invention is shown in FIGS. 3 and 4. FIG. 4 shows a cross section of the blade with the pressure side wall and the suction side wall extending from the leading edge to the trailing edge, and a central cavity 11 formed between the two walls of the airfoil. The pressure side wall includes a plurality of radial extending near wall cooling channels 12 that extend along the airfoil wall from the platform to the tip and open onto the tip surface of the blade. The suction side wall also includes a plurality of radial extending near wall cooling channels 13 that also extend along the entire airfoil wall. The radial near wall cooling channels 12 and 13 extend from the leading edge to the trailing edge regions of the blade to provide complete near wall cooling of the airfoil walls.

FIG. 3 shows a cross section view of one of the radial near wall cooling channels 12 on the pressure side wall. The radial channel 12 includes the near wall cooling channel that flows into a convergent channel 17 located near the tip surface 15 and has a curvature toward the pressure side wall 14. The convergent channel 17 discharges onto the tip surface 15 through a channel opening 16 that is also slanted toward the pressure side wall 14. The pressure side wall 14 also includes a concave shaped section 19 that faces outward as seen in FIG. 3 and forms a deflector surface for the blade tip. The concave shaped section 19 forms a concave shaped depression as seen in FIG. 3. The concave section 19 of the pressure side wall extends along the pressure side airfoil wall from near the leading edge to near the trailing edge wherever the radial channels (12, 13) are in the walls. Each of the radial channels 12 on the pressure side wall are formed as that shown in FIG. 3. The concave shaped depression 19 forms a smooth flow path along the pressure side wall with a tip corner end directing the flow in a forward direction with respect to the hot gas flow through the turbine. This angle at the tip corner is around 30 degrees but can vary more or less depending upon the fluid dynamics to limit leakage across the gap.

The radial channels 12 and 13 are supplied with cooling air from one or more passages formed within the root of the blade. As in the prior art airfoil of the Moore patent (U.S. Pat. No. 5,702,232), the radial channels can be connected to the central cavity through a number of re-supply holes that also produce impingement cooling of the backside surface of the airfoil wall. Also, film cooling holes can be used to discharge film cooling from the radial channels to the outer airfoil surface.

In operation, due to the pressure gradient across the airfoil from the pressure side of the blade to the downstream section of the blade suction side, the secondary flow near the pressure side surface will migrate from the lower blade span and upward across the blade tip end. The near wall secondary flow will follow the contour of the concave pressure surface on the airfoil peripheral and flow upward and across the blade tip crown. At the same time, the multiple near wall radial cooling channels, incorporated into the curved convergent flow channel at the exit, will accelerate the discharged cooling air toward the pressure side surface forming an air cushion against the on-coming hot gas leakage flow through the blade tip gap. This counter flow action will reduce the on-coming leakage flow as well as push the leakage flow outward toward the blade outer air seal 21. In addition to the counter flow action, the slanted blade cooling channel exit geometry forces the secondary flow to bend outward as the leakage enters the pressure side tip corner and yields a smaller vena contractor which thus reduces the effective leakage flow area.

A similar arrangement can also be formed on the suction side wall of the blade with the radial near wall cooling channels if a squealer tip is used on the blade tip. The inner wall surface of the squealer tip on the suction side will have the concave section formed in the tip wall and the converging passages of the near wall radial flow channels will bend toward the pressure side wall to produce the same effect as that described with the pressure side wall radial flow channels. The end result for this combination is to reduce the blade leakage flow and to provide for improved cooling of the blade pressure side tip location.

The creation of the leakage flow resistance by the blade near wall cooling channel geometry and the cooling flow injection yields a very high resistance for the leakage flow path and thus reduces the blade leakage flow. Consequently, it reduces the blade tip section cooling flow mal-distribution and prolongs the blade useful life.

I claim the following:

1. A turbine blade comprising:

an airfoil having a pressure side wall and a suction side wall extending between a leading edge and a trailing edge;

a central cavity formed in the airfoil between the pressure side wall and the suction side wall;

a radial extending near wall cooling channel formed within the pressure side wall and extending along the airfoil and opening onto the blade tip;

the radial extending near wall cooling channel having a converging channel at the tip end that opens onto a tip surface of the blade; and, the pressure side wall having an external surface with a concave shaped depression adjacent to the converging channel and to the blade tip.

2. The turbine blade of claim 1, and further comprising:

the converging channel has a blade tip discharge direction toward the on-coming hot gas flow.

3. The turbine blade of claim 1, and further comprising:

a spanwise length of the concave shaped depression is about the same as a spanwise length of the converging section.

4. The turbine blade of claim 1, and further comprising:

a plurality of radial extending near wall cooling channels formed within the pressure side wall, each having a converging channel opening onto the blade tip; and, the concave shaped depression extends along the pressure side wall adjacent to the plurality of radial extending near wall cooling channels.

5. The turbine blade of claim 4, and further comprising:

the radial extending near wall cooling channels extend from the leading edge region to the trailing edge region of the airfoil.

6. The turbine blade of claim 4, and further comprising:

some of the radial extending near wall cooling channels are connected to the central cavity through a cooling air re-supply hole.

7. The turbine blade of claim 4, and further comprising:

some of the radial extending near wall cooling channels include film cooling holes to discharge a layer of film cooling air onto the outer airfoil surface.

8. The turbine blade of claim 2, and further comprising:

the blade tip discharge opening of the converging channel is located on the blade tip adjacent to the tip corner.

9. The turbine blade of claim 1, and further comprising:

the converging channel is a gradually converging channel.

10. The turbine blade of claim 1, and further comprising:

a cross sectional curvature of the converging channel is about the same as the concave shaped depression surface.

11. The turbine blade of claim 1, and further comprising:

the blade tip includes a squealer tip formed by a pressure side tip rail and a suction side tip rail; and, the converging channel on the pressure side wall opens onto the pressure side tip rail crown.

12. The turbine blade of claim 11, and further comprising:

the suction side wall includes a suction side radial extending near wall cooling channel; and, the suction side radial extending near wall cooling channel having a converging channel at the tip end.

13. The turbine blade of claim 12, and further comprising:

the inner side of the suction side tip rail includes a concave shaped depression adjacent to the converging channel in the suction side tip rail.

14. The turbine blade of claim 11, and further comprising:

the converging channel on the suction side tip rail is directed to discharge the cooling air in a direction more toward the on-coming hot gas flow.

15. The turbine blade of claim 11, and further comprising:

a plurality of radial extending near wall cooling channels formed within the suction side wall, each having a converging channel opening onto the suction side tip rail; and, the concave shaped depression extends along the suction side wall adjacent to the plurality of radial extending near wall cooling channels.

* * * * *